US010857438B2

(12) United States Patent
Givens

(10) Patent No.: US 10,857,438 B2
(45) Date of Patent: Dec. 8, 2020

(54) LOCKING APPARATUS FOR AN ADJUSTABLE BASKETBALL GOAL

(71) Applicant: Jon Casey Givens, Katy, TX (US)

(72) Inventor: Jon Casey Givens, Katy, TX (US)

(73) Assignee: MEGA SLAM HOOPS, LLC, San Antonio, TX (US)

( * ) Notice: Subject to any disclaimer, the term of this patent is extended or adjusted under 35 U.S.C. 154(b) by 0 days.

(21) Appl. No.: 15/701,604

(22) Filed: Sep. 12, 2017

(65) Prior Publication Data

US 2019/0076712 A1 Mar. 14, 2019

(51) Int. Cl.

| | |
|---|---|
| ***A63B 63/08*** | (2006.01) |
| ***E05B 73/00*** | (2006.01) |
| ***E05B 67/38*** | (2006.01) |
| ***A63B 1/00*** | (2006.01) |

(52) U.S. Cl.

CPC ..... *A63B 63/083* (2013.01); *A63B 1/00* (2013.01); *E05B 67/383* (2013.01); *E05B 73/00* (2013.01); *A63B 2225/093* (2013.01); *A63B 2225/72* (2013.01)

(58) Field of Classification Search

CPC ..... A63B 63/083; E05B 67/383; E05B 73/00
USPC ..... 473/483, 479; 70/14, 58, 232, 177, 178, 70/180; 248/551

See application file for complete search history.

(56) References Cited

U.S. PATENT DOCUMENTS

| | | | | |
|---|---|---|---|---|
| 1,683,649 | A * | 9/1928 | Belote | F16K 35/10 70/178 |
| 3,843,173 | A * | 10/1974 | Harrell | E05B 13/002 292/7 |
| 4,732,024 | A * | 3/1988 | Nagy | E05B 17/14 70/423 |
| 5,215,112 | A * | 6/1993 | Davison | F16K 35/06 137/385 |
| 6,302,811 | B1 * | 10/2001 | Topham | A63B 63/083 248/280.11 |
| 8,087,268 | B1 * | 1/2012 | Pruitt | E05B 67/383 70/14 |

* cited by examiner

*Primary Examiner* — John E Simms, Jr.
*Assistant Examiner* — Rayshun K Peng
(74) *Attorney, Agent, or Firm* — Nolte Lackenbach Siegel

(57) ABSTRACT

A locking apparatus for an adjustable basketball goal. The locking apparatus may include a center plate, a sleeve, a first side plate, and a second side plate. The center plate may define a center plate opening. The sleeve may extend from the center plate and define a bore extending therethrough. The bore may terminate at the center plate opening, and the sleeve may further define a pair of apertures disposed opposite one another. The first side plate may extend from a first end portion of the center plate. The second side plate may extend from a second end portion of the center plate.

19 Claims, 6 Drawing Sheets

LOCKING APPARATUS FOR AN ADJUSTABLE BASKETBALL GOAL

BACKGROUND

Basketball goals are frequently used in areas outside of professional basketball arenas. These basketball goals are typically mounted to a pole or wall, and may include a mechanism to adjust the height of the goal. One such mechanism may be an actuator defining an opening through which a pin may be inserted, thereby coupling a handle to the actuator. The handle may be manipulated to raise or lower the goal to a desired height. Thereafter, the pin may be removed, thereby decoupling the handle from the actuator and fixing the goal at the desired height.

Although the handle may be decoupled from the actuator, it has been found that the height of the goal may still be impermissibly adjusted via a screwdriver, rod, or other like device being inserted into the opening of the actuator and rotated in the desired direction by an individual. In cases in which the basketball goal is impermissibly lowered by the individual, the goal may be more susceptible to vandalism by the individual or others.

What is needed, therefore, is a locking mechanism configured to prevent an individual from impermissibly adjusting the height of a basketball goal.

SUMMARY

Embodiments of the disclosure may provide a locking apparatus for an adjustable basketball goal. The locking apparatus may include a center plate, a sleeve, a first side plate, and a second side plate. The center plate may define a center plate opening. The sleeve may extend from the center plate and define a bore extending therethrough. The bore may terminate at the center plate opening, and the sleeve may further define a pair of apertures disposed opposite one another. The first side plate may extend from a first end portion of the center plate. The second side plate may extend from a second end portion of the center plate.

Embodiments of the disclosure may further provide an actuator assembly for an adjustable basketball goal. The actuator assembly may include an actuator, a crankshaft, a locking apparatus, and a lock. The actuator may include a rotatable rod having a head portion defining an opening extending therethrough. The actuator may be configured to adjust a height of the adjustable basketball goal based on a rotation of the rotatable rod. The crankshaft may be detachably attachable to the rotatable rod and configured to rotate the rotatable rod. The locking apparatus may include a center plate, a sleeve, a first side plate, and a second side plate. The first side plate and the second side plate may each extend from the center plate. The sleeve may extend from the center plate and define a bore extending therethrough. The bore may be configured to receive the head portion of the rotatable rod when the crankshaft is detached from the rotatable rod. The sleeve may further define a pair of apertures. The lock may include a shackle and a locking body. The shackle in a locked position with the locking body may be configured to extend through the pair of apertures and the opening defined by the head portion. In the locked position, the first side plate and the second side plate may be configured to prevent rotation of the rotatable rod and adjustment of the height of the adjustable basketball goal.

Embodiments of the disclosure may further provide an adjustable basketball goal. The adjustable basketball goal may include a backboard, a rim assembly, a plurality of support arms, a post, and an actuator assembly. The rim assembly may be configured to couple to the backboard. The plurality of support arms may be configured to couple to the backboard. The post may be configured to couple to the plurality of support arms. The actuator assembly may be configured to couple to the post and the plurality of support arms. The actuator assembly may include an actuator, a locking apparatus, and a lock. The actuator may include a rotatable rod having a head portion defining an opening extending therethrough. The actuator may be configured to adjust a height of the adjustable basketball goal based on a rotation of the rotatable rod via a crankshaft. The locking apparatus may include a center plate, a plurality of side plates, and a sleeve. The plurality of side plates may extend from the center plate. The sleeve may define a bore extending therethrough and a pair of apertures. The lock may have a locking body and a shackle. The shackle in a locked position may be configured to extend through the pair of apertures and the opening extending through the head portion. In the locked position, the plurality of side plates may be configured to prevent the rotatable rod from rotating and adjusting the height of the adjustable basketball goal.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
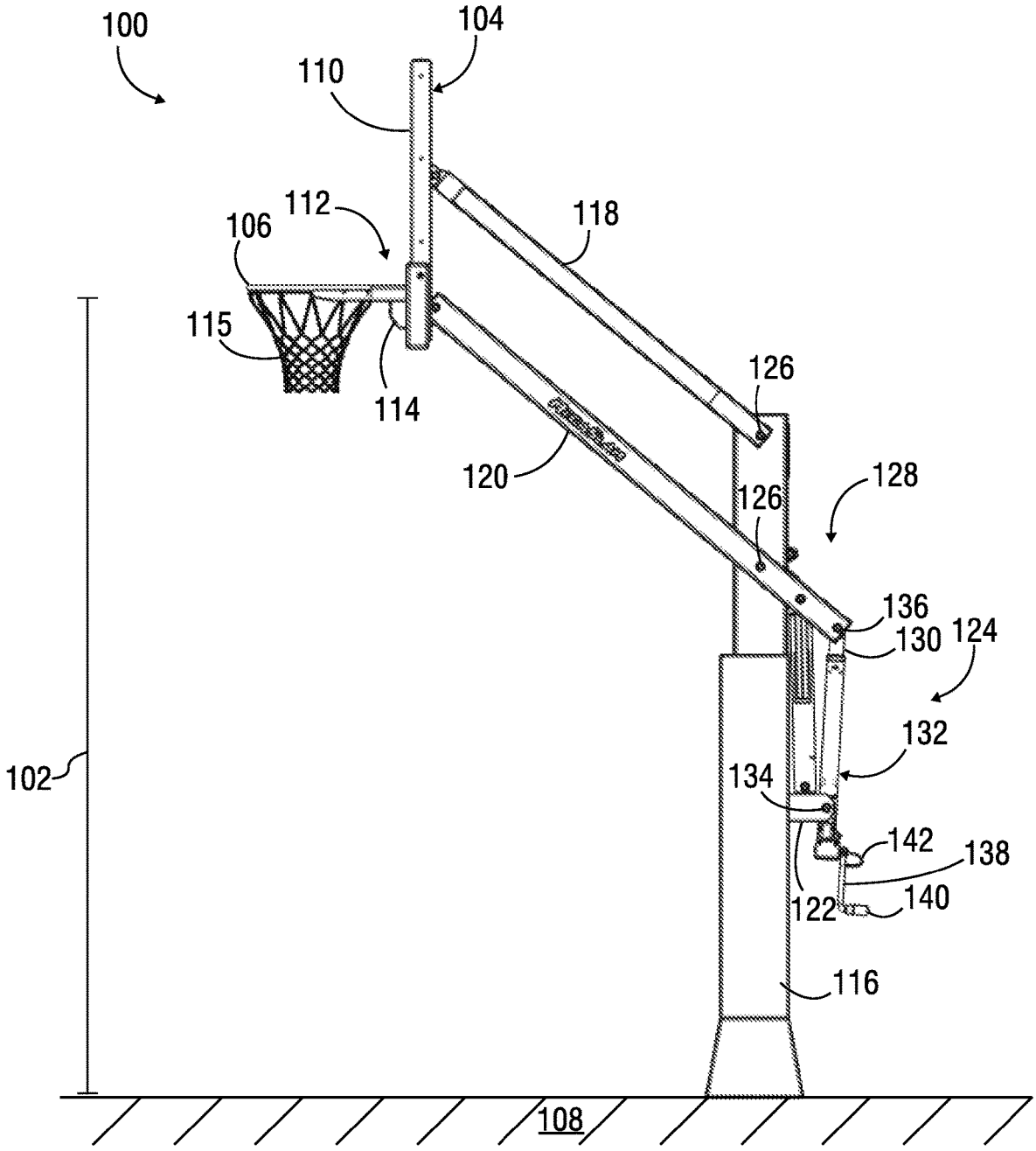
FIG. 1 illustrates a side view of an adjustable basketball goal in a raised position, according to one or more embodiments.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 2:
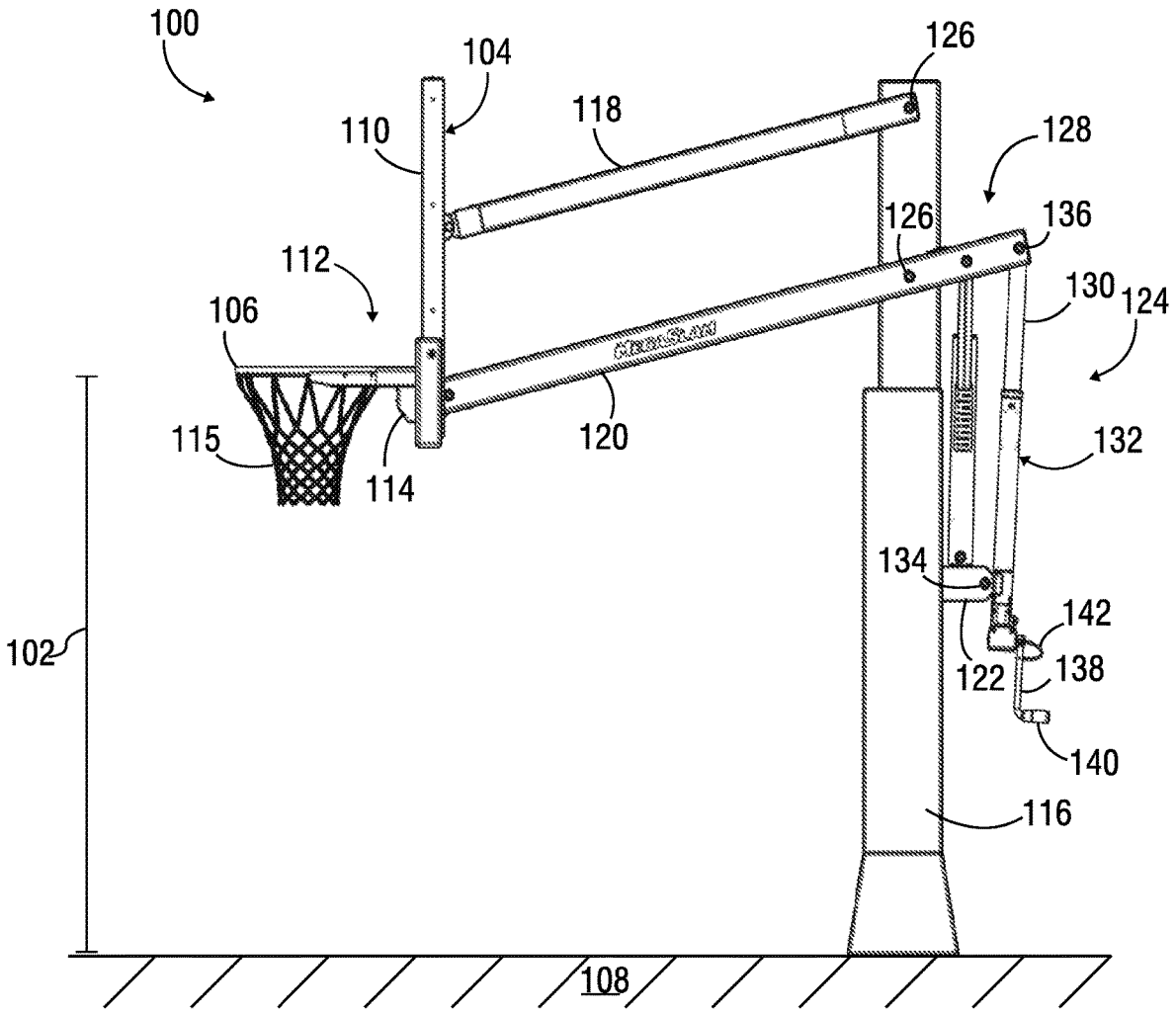
FIG. 2 illustrates a side view of the adjustable basketball goal of FIG. 1 in a lowered position.

FIGS. 1 and 2 illustrate side views of an adjustable basketball goal 100 in respective raised and lowered positions, according to one or more embodiments of the present disclosure. As will be discussed in further detail below, the raised and lowered positions of the adjustable basketball goal 100 are reflective of a height 102 of a backboard 104, and more particularly, a rim 106 of the adjustable basketball goal 100 with reference to the ground 108. The adjustable basketball goal 100 may be configured to position the rim 106 at a plurality of heights 102 ranging from about five feet above the ground 108 to about ten feet above the ground 108.

As the backboard 104 and the rim 106 may be more susceptible to "dunking" or "slamming" of the basketball (not shown) through the rim 106 at a lowered position (FIG. 2), the backboard 104 may include a backboard support frame 110 surrounding a panel (not shown). In one or more embodiments, the panel may be constructed from a clear material, such as glass, tempered glass, plexiglass, or polycarbonate. This may allow a clear view through the panel.

A rim assembly 112 including the rim 106 and a mounting plate 114 may be coupled to the backboard 104. In particular, in one or more embodiments, the mounting plate 114 may be coupled to the backboard support frame 110 using bolts, adhesives, welds, or other similar means. In other embodiments, the mounting plate 114 may also be coupled to the panel using bolts or adhesives. In some embodiments, a cloth or chain net 115 may be attached to the rim 106.

The rim assembly 112 may be a fixed type rim assembly with the mounting plate 114 and the rim 106 rigidly coupled together. In other embodiments, the rim assembly 112 may be a collapsible style rim assembly. A collapsible style rim assembly may allow the rim 106 to flex independently of the mounting plate 114, allowing the rim assembly 112 to absorb some of the force when the rim 106 is pulled during or after "dunking" or "slamming" the basketball therethrough.

The adjustable basketball goal 100 may further include a post 116, a plurality of support arms 118, 120 coupling the post 116 to the backboard 104, an actuator mounting bracket 122, and an actuator assembly 124. The post 116 may be anchored to the ground 108 and extend substantially vertically therefrom. In one or more embodiments, the post 116 may be anchored to the ground 108 via concrete and a plurality of fasteners such as screws or bolts (not shown). In at least one embodiment, the post 116 may be rectangular in cross section; however, in other embodiments, the post 116 may be square, circular, or oval in cross section. The post 116 may be at least partially covered in padding (not shown) constructed from foam or other like material.

The backboard 104 may be coupled to the post 116 via the plurality of support arms 118, 120. The plurality of support arms 118, 120 may include a pair of upper support arms (one shown 118) pivotably attached to the post 116 and a pair of lower support arms (one shown 120) pivotably attached to the post 116 and vertically spaced from the pair of upper support arms 118. Each of the upper support arms 118 and the lower support arms 120 may be pivotably attached to the post 116 using one or more bolts or pins 126. In one or more embodiments, each of the pair of upper support arms 118 and the pair of lower support arms 120 may include one or more cross members (not shown) extending therebetween to provide structural support thereto.

Respective end portions (one shown 128) of the pair of lower support arms 120 may be coupled to the actuator assembly 124, as shown in FIGS. 1 and 2. More particularly, in one or more embodiments, the respective end portions 128 of the pair of lower support arms 120 may be coupled to an extendable or retractable shaft 130 of an actuator 132 of the actuator assembly 124. The actuator 132 may be further coupled to the post 116 via the actuator mounting bracket 122, as shown in FIGS. 1 and 2.

Figure 3:
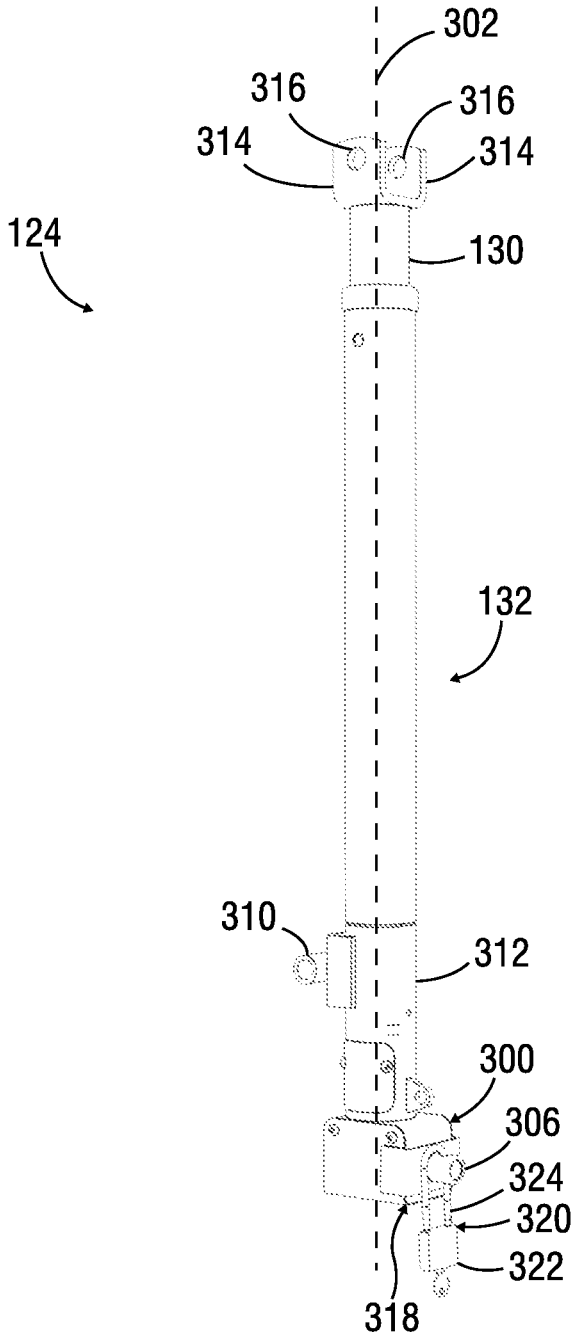
FIG. 3 illustrates a perspective view of an actuator assembly, as may be used in the embodiments of FIGS. 1 and 2.
Figure 4:
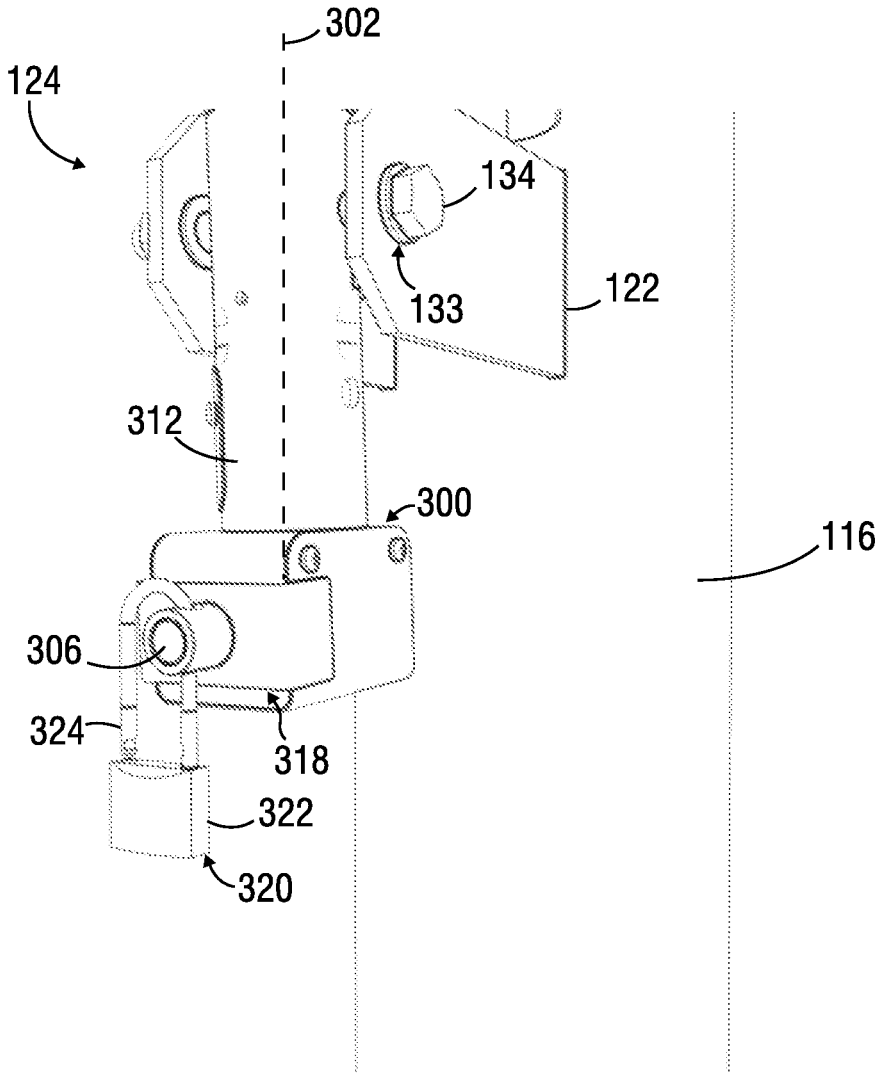
FIG. 4 illustrates an enlarged perspective view of a lower portion of the actuator assembly of FIG. 3.
Figure 5:
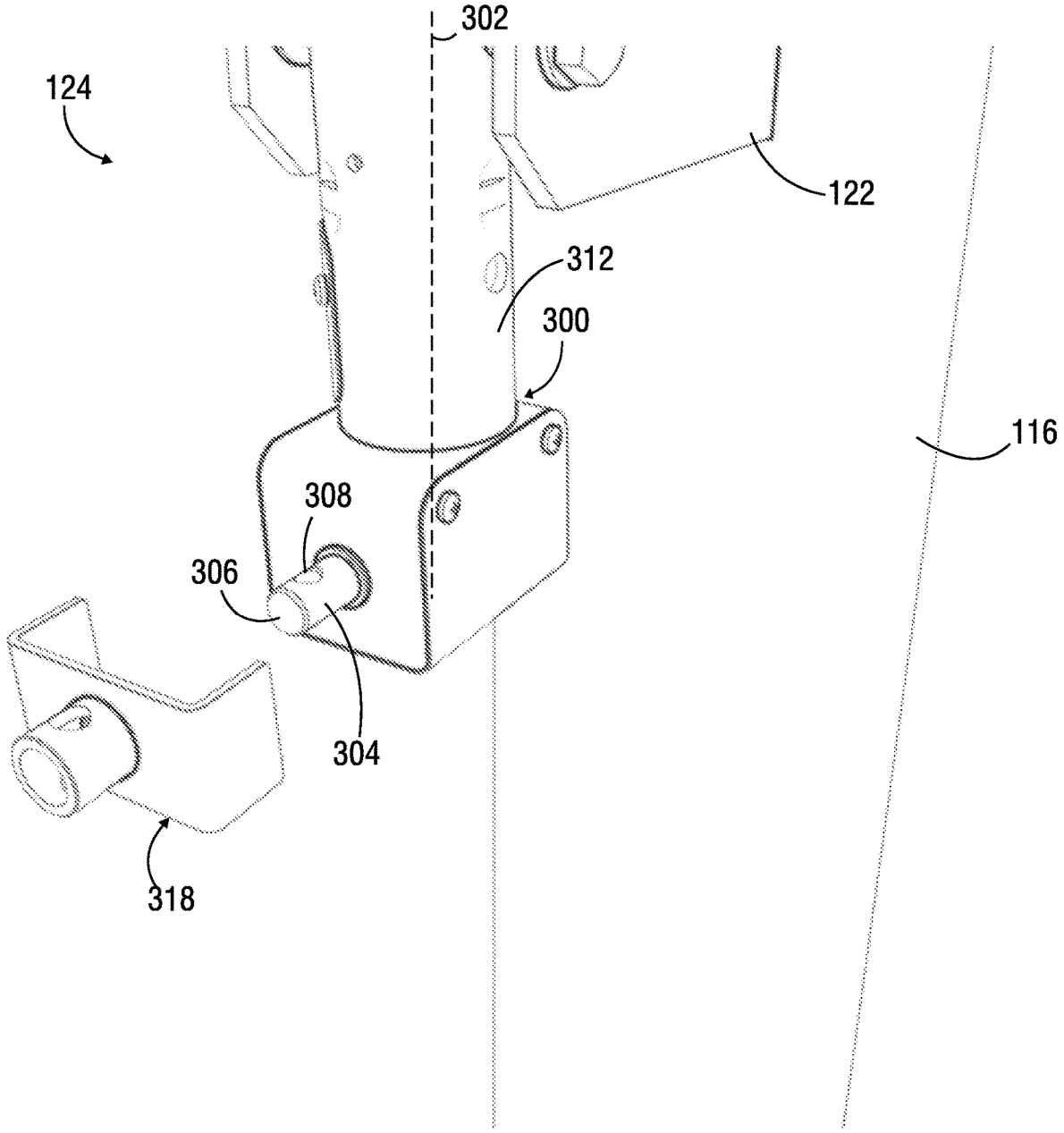
FIG. 5 illustrates an exploded view of a portion of the actuator assembly of FIGS. 3 and 4.

Referring now to FIGS. 3-5 with continued reference to FIGS. 1 and 2, FIG. 3 illustrates a perspective view of the actuator assembly 124 with the remainder of the adjustable basketball goal 100 omitted for clarity purposes, according to one or more embodiments. FIG. 4 illustrates an enlarged perspective view of a lower portion of the actuator assembly 124 coupled to the actuator mounting bracket 122. FIG. 5 illustrates an exploded view of a portion of the actuator assembly 124, according to one or more embodiments.

The actuator 132 of the actuator assembly 124 may include a housing 300 having a longitudinal axis 302, a plurality of springs (not shown) disposed within the housing 300, the shaft 130 (FIGS. 1-3) at least partially disposed within the housing 300, and a screw or rotatable rod 304 having a head portion 306 defining an opening 308 extending therethrough (most clearly seen in FIG. 5). A tubular member 310 may be mounted to or integral with an exterior surface 312 of the housing 300 and configured to align with apertures 133 defined in the actuator mounting bracket 122, such that a fastening member 134, such as a pin or bolt, may be inserted through the tubular member 310 and the apertures of the actuator mounting bracket to couple the actuator assembly 124 to the post 116.

As shown in FIG. 3, an end portion of the shaft 130 may include tabs 314 defining apertures 316 through which a bolt or pin (see FIGS. 1 and 2, 136) may be extended to couple the pair of lower support arms 120 to the shaft 130. The shaft 130 may be further operatively connected to the plurality of springs and the rotatable rod 304, such that the rotation of the rotatable rod 304 may result in the movement of the shaft 130 along the longitudinal axis 302.

For example, the rotation of the rotatable rod 304 in the clockwise direction may result in the length of the shaft 130 extending from the housing 300 increasing. Conversely, the rotation of the rotatable rod 304 in the counter-clockwise direction may result in the length of the shaft 130 extending from the housing 300 decreasing. Accordingly, as the shaft 130 is extended further from the housing 300, the backboard 104 and rim 106 are lowered correspondingly, thereby decreasing the height 102 of the rim 106 above the ground 108. Conversely, as the shaft 130 is retracted further into the housing 300, the backboard 104 and rim 106 are raised correspondingly, thereby increasing the height 102 of the rim 106 above the ground 108.

The rotatable rod 304 may be rotated via the opening 308 defined therethrough. Accordingly, in one or more embodiments, the actuator assembly 124 may further include a crankshaft (see FIGS. 1 and 2, 138) having a handle 140 integral with or attached thereto. The crankshaft 138 may be removably coupled to the rotatable rod 304 using a pin assembly 142, as shown in FIGS. 1 and 2. In another embodiment, the crankshaft 138 may be coupled to the rotatable rod 304 using a bolt. After the rim 106 of the adjustable basketball goal 100 reaches the desired height, the crankshaft 138 may be removed to prevent further adjustment of the height 102 of the adjustable basketball goal 100.

To prevent foreign objects (e.g., screwdrivers) from being inserted into the opening 308 defined by the rotatable rod 304, rotating the rotatable rod 304, and impermissibly adjusting the height 102 of the adjustable basketball goal 100, the actuating assembly 124 may further include a locking apparatus 318 installable on the actuator 132 to prevent the rotation of the rotatable rod 304 and thus the adjustment of the height 102 of the adjustable basketball goal 100.

The locking apparatus 318 may be installed over the head portion 306 of the rotatable rod 304 after the crankshaft 138 has been removed. The locking apparatus 318 may be further secured in place via a lock 320, as illustrated in FIGS. 3 and 4. Generally, the lock 320 may be any commercially available padlock or similar locking mechanism having a locking body 322 and a shackle 324 sized to fit within the opening 308 defined in the rotatable rod 304.

Figure 6:
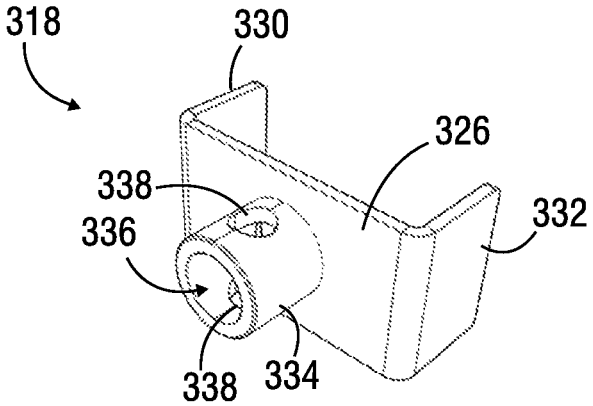
FIG. 6 illustrates a front perspective view of a locking apparatus, according to one or more embodiments.
Figure 7:
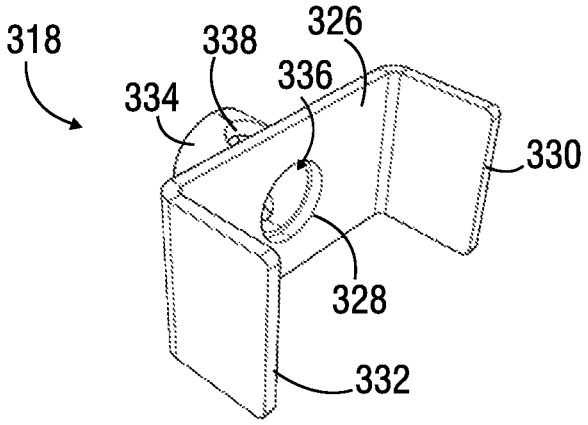
FIG. 7 illustrates a rear perspective view of the locking apparatus of FIG. 6.
Figure 8:
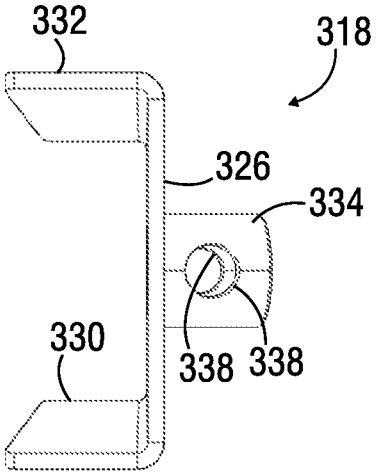
FIG. 8 illustrates a plan view of the locking apparatus of FIG. 6.

Turning now to FIGS. 6-8 with continued reference to FIGS. 1-5, FIGS. 6 and 7 show respective front and rear perspective views of the locking apparatus 318, according to one or more embodiments. FIG. 8 illustrates a plan view of the locking apparatus 318 of FIGS. 6 and 7. The locking apparatus 318 may include a center plate 326 defining an opening 328 through which a portion of the rotatable rod 304 may extend when installed on the actuator 132. As shown in FIGS. 6 and 7, the center plate 326 may be rectangular in shape and substantially planar; however, in other embodiments, the center plate 326 may be square-shaped and/or may have a curvature. Generally, the shape and size of the center plate 326 may correspond to the shape and size of the exterior surface 312 of the housing 300 adjacent the rotatable rod 304.

The locking apparatus 318 may further include a plurality of side plates 330, 332 extending from opposing end portions of the center plate 326. As illustrated in FIGS. 6-8, the locking apparatus 318 may include a first side plate 330 and a second side plate 332 extending from respective end portions of the center plate 326. Each side plate 330, 332 may extend from the center plate 326 at an angle of about ninety degrees. Accordingly, each side plate 330, 332 may extend substantially perpendicularly from the center plate 326 and may be substantially parallel with one another. Each side plate 330, 332 may be substantially planar and rectangular in shape; however, in other embodiments, each side plate 330, 332 may be square-shaped and/or may have a curvature. Generally, the shape and size of each side plate 330, 332 may correspond to the shape and size of the exterior surface 312 of the housing 300 adjacent the rotatable rod 304.

The locking apparatus 318 may further include a sleeve 334 extending from the center plate 326 and defining a bore 336 extending therethrough and terminating at the opening 328 of the center plate 326. As installed on the actuator 132, the rotatable rod 304 may extend through the opening 328 defined by the center plate 326 and into the bore 336 of the sleeve 334. The sleeve 334 may further define a plurality of apertures 338 configured to align with the respective ends of the opening 308 extending through the rotatable rod 304. The lock 320 (FIGS. 3 and 4) may extend through the plurality of apertures 338 and the opening 308 defined in the rotatable rod 304, thereby securing the locking apparatus 318 to the actuator 132 and preventing the rotatable rod 304 from rotating.

The description herein uses terms such as 'lower', 'upper', etc., that are relative in nature. Those skilled in the art and having the benefit of this disclosure will appreciate that these terms are used relative to the orientation of the adjustable basketball goal 100 and components thereof with respect to the ground 108, as in, for example, FIGS. 1 and 2.

The foregoing has outlined features of several embodiments so that those skilled in the art may better understand the present, disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. An actuator locking apparatus for an adjustable basketball goal, the adjustable basketball goal having:

an actuator assembly;

a housing for the actuator assembly a detachable crank; and a rotatable rod having a head portion extending from the housing to attach to the detachable crank and effect, via rotation using the detachable crank attached to the head portion of the rotatable rod, the actuator assembly to adjust height of the adjustable basketball goal, the actuator locking apparatus comprising:

a center plate defining a center plate opening;

a sleeve extending from the center plate and defining a bore extending therethrough, the bore to accept insertion of the head portion of the rotatable rod after removal of the detachable crank and terminating at the center plate opening, the sleeve encircling the center plate opening and further defining a pair of apertures disposed opposite one another, the pair of apertures spaced to align with respective ends of a head opening through the rotatable rod, the sleeve to substantially cover and surround a circumferential perimeter of the head portion;

a first side plate extending from a first end portion of the center plate; and a second side plate extending from a second end portion of the center plate, the spacing between the first side plate and the second side plate to accommodate placement on opposite sides of the housing while the head portion is inserted in the bore, wherein the first side plate and the second side plate prevent rotation of the center plate via contact with the housing on either side; and wherein rotation of the rotatable rod is constrained via the actuator locking apparatus upon placement of an object extending through both the pair of apertures on the sleeve and the head opening through the rotatable rod.

2. The locking apparatus of claim 1, wherein the sleeve has an inner surface and an outer surface, the inner surface of the sleeve defining the bore, and each aperture extending from the outer surface of the sleeve to the inner surface of the sleeve.

3. The locking apparatus of claim 1, wherein the sleeve extends from the center plate in a first direction and each of the first side plate and the second side plate extends from the center plate in a substantially opposite direction from the first direction.

4. The locking apparatus of claim 1, wherein each aperture is sized and configured to receive therethrough a shackle of a padlock as the object, and upon insertion of the shackle through each aperture, when aligned with the opening through the head opening of the rotatable rod, the shackle further passes through the head opening to prevent rotation.

5. The locking apparatus of claim 1, wherein each of the first side plate and the second side plate extends substantially perpendicular from the center plate.

6. The locking apparatus of claim 1, wherein each of the first side plate and the second side plate extends substantially parallel to one another.

7. The locking apparatus of claim 1, wherein at least one of the center plate, the first side plate, and the second side plate is rectangular.

8. The locking apparatus of claim 1, wherein the center plate opening and the bore are concentric.

9. An actuator assembly for an adjustable basketball goal comprising:

an actuator including a rotatable rod having a head portion extending through the housing and having a head opening extending therethrough, the actuator to adjust a height of the adjustable basketball goal based on a rotation of the rotatable rod;

a housing having at least a first exterior surface and a second exterior surface on opposite sides of the actuator;

a crankshaft detachably attachable to the rotatable rod at the head portion via the head opening to rotate the rotatable rod using the detachable crankshaft attached to the head portion; and a locking apparatus including:

a center plate defining a center plate opening;

a first side plate and a second side plate each extending from the center plate wherein the first side plate and the second side plate prevent rotation of the center plate by contact with the first exterior surface and the second exterior surface of the housing; and a sleeve extending from the center plate and defining a bore extending therethrough, the bore terminating at the center plate opening to receive the head portion of the rotatable rod when the crankshaft is detached from the rotatable rod, and the sleeve encircling the center plate opening and further defining a pair of apertures spaced to align with respective ends of the head opening, the sleeve to substantially cover and surround a circumferential perimeter of the head portion; and a lock including a shackle and a locking body, the shackle in a locked position with the locking body, the shackle to extend through the pair of apertures and the head opening to restrict rotation of the rotatable rod, wherein, in the locked position, the first side plate and the second side plate are to prevent rotation of the rotatable rod and adjustment of the height of the adjustable basketball goal.

10. The actuator assembly of claim 9, wherein the sleeve has an inner surface and an outer surface, the inner surface of the sleeve defining the bore, and each aperture extending from the outer surface of the sleeve to the inner surface of the sleeve.

11. The actuator assembly of claim 9, wherein the locking apparatus allows the first side plate being positioned on one side of the housing, and the second side plate being positioned on an opposing side of the housing while the head portion is inserted into the bore.

12. The actuator assembly of claim 9, wherein the sleeve extends from the center plate in a first direction and each of the first side plate and the second side plate extends from the center plate in a substantially opposite direction from the first direction.

13. The actuator assembly of claim 9, wherein the first side plate extends from a first end portion of the center plate, and the second side plate extends from a second end portion of the center plate.

14. The actuator assembly of claim 13, wherein each of the first side plate and the second side plate extends substantially parallel to one another.

15. An adjustable basketball goal, comprising:

a backboard;

a rim assembly to couple to the backboard;

a plurality of support arms to couple to the backboard;

a post to couple to the plurality of support arms; and an actuator assembly to couple to the post and the plurality of support arms, the actuator assembly comprising:

an actuator including a rotatable rod having a head portion defining a head opening extending therethrough, the actuator to adjust a height of the adjustable basketball goal based on a rotation of the rotatable rod using a detachable crankshaft attached to the head portion;

a housing having at least a first exterior surface and a second exterior surface on opposite sides of the actuator, the head portion of the rotatable rod extending external to the housing;

a locking apparatus having a center plate and a plurality of side plates extending therefrom, the plurality of sides plates preventing rotation of the center plate by contact with either the first exterior surface or the second exterior surface, the locking apparatus further including a sleeve encircling a center plate opening defined by the center plate, the sleeve further defining a bore extending therethrough sized for insertion of the head portion after removal of the detachable crankshaft and a pair of apertures spaced to align with respective ends of the head opening, the bore terminating at the center plate opening, the sleeve to substantially cover and surround a circumferential perimeter of the head portion; and a lock having a locking body and a shackle, the shackle in a locked position to extend simultaneously through the pair of apertures and the head opening to restrict rotation of the rotatable rod, wherein, in the locked position, the plurality of side plates prevent the rotatable rod from rotating and adjusting the height of the adjustable basketball goal.

16. The adjustable basketball goal of claim 15, wherein the sleeve has an inner surface and an outer surface, the inner surface of the sleeve defining the bore, and each aperture extending from the outer surface of the sleeve to the inner surface of the sleeve.

17. The adjustable basketball goal of claim 15, wherein the plurality of side plates include a first side plate being positioned on one side of the housing, and a second side plate being positioned on an opposing side of the housing while the head portion is inserted into the bore.

18. The adjustable basketball goal of claim 17, wherein the sleeve extends from the center plate in a first direction and each of the first side plate and the second side plate extends from the center plate in a substantially opposite direction from the first direction.

19. The adjustable basketball goal of claim 18, wherein each of the first side plate and the second side plate extends substantially parallel to one another.

* * * * *